United States Patent [19]

Surti

[11] Patent Number: 4,947,216

[45] Date of Patent: Aug. 7, 1990

[54] CLEANING BLADE ASSEMBLY FOR ELECTROPHOTOGRAPHY APPARATUS

[76] Inventor: Tyrone N. Surti, 424 Harding Industrial Dr., Nashville, Tenn. 37211

[21] Appl. No.: 312,687

[22] Filed: Feb. 21, 1989

[51] Int. Cl.[5] ..... G03G 21/00

[52] U.S. Cl. ..... 355/299; 15/256.51

[58] Field of Search ..... 355/299, 296, 1; 15/256.5, 256.51

[56] References Cited

U.S. PATENT DOCUMENTS 4,768,062 8/1988 Tanzawa et al. ..... 355/299 X

FOREIGN PATENT DOCUMENTS 61-5273 1/1986 Japan ..... 355/299

OTHER PUBLICATIONS

Xerox Disclosure Journal, vol. 1, No. 4, Apr. '76, p. 79.

*Primary Examiner*—R. L. Moses

*Attorney, Agent, or Firm*—C. A. Phillips

[57] ABSTRACT

A cleaning device for an electrophotographic copying device wherein an electrophotographic latent image formed on the surface of a photosensitive member is moved past a series of processing stations including a developing station at which the latent image is developed with a toner to form a toner image and a transfer station at which the toner image is transferred to a copying material. The cleaning device includes a housing having a reservoir therein and an aperture extending longitudinally along the housing in communication with the reservoir to direct spent toner particles therein. A wiper blade is secured to the housing and extends therefrom. The blade is provided with a cleaning edge disposed for contact with the surface of the photosensitive member and for application of a predetermined pressure to the photosensitive surface responsive to contact of the blade with the photosensitive surface for cleaning the toner from the photosensitive surface. Biasing means is provided for biasing the blade against the surface of the photosensitive member for maintaining a predetermined pressure between the blade and the photosensitive surface. The blade may be provided with electrically conductive members or with light directing paths which respectively conduct an electric charge away from the photosensitive surface or directs light to the photosensitive surface to discharge any electrostatic charge therefrom.

14 Claims, 4 Drawing Sheets

CLEANING BLADE ASSEMBLY FOR ELECTROPHOTOGRAPHY APPARATUS

TECHNICAL FIELD

This invention relates generally to an image-forming apparatus and more particularly to a cleaning blade assembly for cleaning developer or toner particles off of a photosensitive member of the image-forming apparatus.

BACKGROUND OF THE INVENTION

Image-forming apparatus typically include an image-bearing photosensitive member, such as a drum, on which an image is formed as the drum is rotated past a developer member and subsequently transferred from the drum to a sheet of paper or the like. After the image is formed and transferred, any developer of toner remaining on the drum must be removed by a cleaning member. Such cleaning members are known in the art and generally include a housing enclosing a fixed elastic blade or brush to clean the developer off of the drum by a wiping or brushing action. The particles are normally recovered through an elongated aperture communicating into a lower chamber of the cleaner housing in which the blade or brush is mounted. The particles collected in the chamber are either stored therein and discarded along with the housing assembly or are collected and reused.

Wiper blades used in such cleaning devices generally have a flat surface which extends along the length of the drum, and as the drum rotates, the lower edge of the blade contacts the drum along a line on the surface of the drum along the length thereof.

The wiper blade of such cleaning devices generally is made of rubber or a flexible plastic material and is usually rigidly and permanently mounted to the housing and extends therefrom for contact with the surface of the photosensitive drum. Typically, the wiper blades of the cleaning device are not replaceable even though they are subject to wear. Additionally, a partition is sometimes provided to help guide the falling developer particles into the chamber through the elongated aperture in the housing adjacent the chamber. The partition is normally adhered to the outer surface of the housing and extends away from the surface adjacent the elongated aperture. U.S. Pat. Nos. 4,639,123 and 4,530,594 disclose such structure.

The cleaner housing is typically rigidly mounted in the printing apparatus or rigidly mounted in a kit which is removably mounted in the main body of the printing apparatus. The wiper blade is generaly rigidly mounted relative to the drum, and because of such rigid mounting, it is necessary to precisely position the cleaner housing relative to the drum so that the proper amount of contact pressure may be applied to the drum by the wiper blade. If the blade exerts an excessive amount of pressure on the drum, the sensitive surface of the drum become scratched. On the other hand, too little pressure will fail to remove all of the developer particles from the drum.

Additionally, the construction of the housing with a lower partition ahdered thereto on its outer surface and extending along the aperture through which developer or toner paticles are collected provides a "catch all" trough along the length of the aperture in which some of the used developer particles are undesirably captured.

It is an object of the present invention to provide a cleaning device assembly for use in an image-forming apparatus.

It is a further object of the present invention to provide such a cleaning device with a wiper blade housing having a reservoir therein to collect used developer or toner particles.

It is a further object of the present invention to provide such a housing with a wiper blade assembly disposed in biased relation with the sensitive surface of a photosensitive member on an electrophotographic copying apparatus for retention of the wiper blade in contact with said sensitive surface at a predetermined contact pressure.

It is yet a further object of the present invention to provide such a housing with a lower guide member for guiding substantially all the used particles into the reservoir.

It is yet a further object of an embodiment of the present invention to provide such a cleaning device with a cleaning blade which is made of electrically conductive material for removing an electrical charge applied to the photosensitive member.

It is even yet a further object of the present invention to provide a cleaning assembly for an electrophotography apparatus, such cleaning assembly including a wiper blade having light directing paths therein for directing light to a photesensitive drum carried in the electrophotography apparatus.

A final object of the invention is to provide a cleaning assembly for an electrophotography apparatus with a wiper blade which is readily replaceable.

SUMMARY OF THE INVENTION

This invention relates to a cleaning device assembly for use in an image-fomring apparatus. The cleaning device is disposed for removing developer particles from a photosensitive drum of the image forming device after the development process has been completed and includes a housing mounted in the image-forming apparatus and a wiper arm mounted in the housing for exerting a predetermined pressure against the photosensitive surface of a photosenstive member of the image-forming device. The housing of the cleaning device includes access means for providing access into the interior thereof. Additionally, the wiper blade may be alectrically conductive or non-conductive. Alternately, the wiper blade is provided with light directing paths to direct light to the photosensitive surface of the drum to erase the electrical charge imposed thereon prior to the drum being rotated through a developing station of the apparatus.

DESCRIPTION OF THE PREFERRED EMBODIMENT

Figure 1:
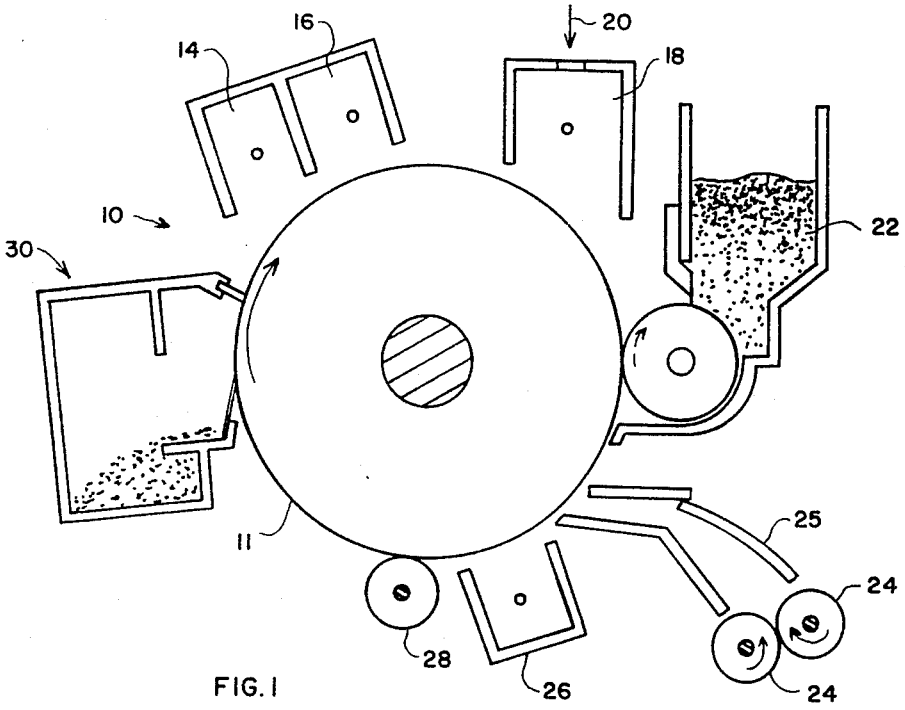
FIG. 1 is a schematic cross-sectional view of a copier provided with a cleaning device embodying the present invention.

FIG. 1 is a pictorial, diagrammatic view of one embodiment of the present invention. As seen in FIG. 1, an image-forming apparatus 10 includes a photosensitive drum 11 mounted therein. The drum may be mounted in a removable process kit or other support members 12 in printing apparatus 10. Mounted around the periphery of drum 11 in known fashion is a corona pre-discharger 14, a pair of corona dischargers 16 and 18, and image exposure 20, a developing device 22 having toner material therein, transfer sheet guide rollers 24 and guide members 25, a transfer corona discharger 26, a separating roller 28, and a cleaning device 30.

Figure 2:
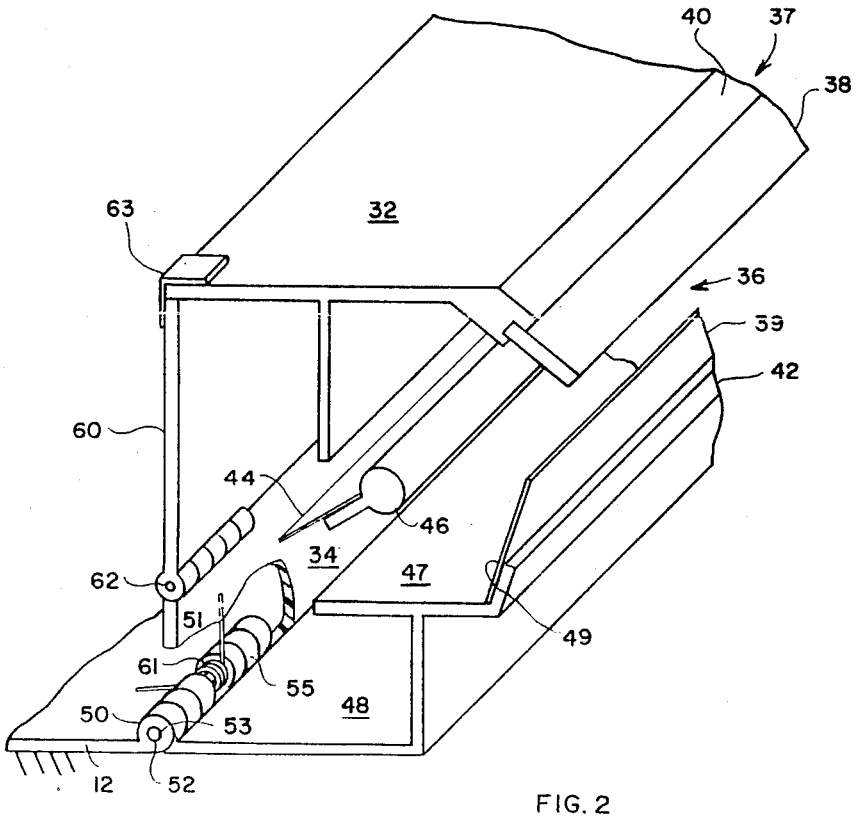
FIG. 2 is a pictorial view of an embodiment of the present ivention illustrating a housing disposed for pivotal mounting in a copying apparatus and provided with a wiper blade rigidly secured to the housing, the housing having the back thereof pivotally mounted to permit access into the interior of the housing.
Figure 3:
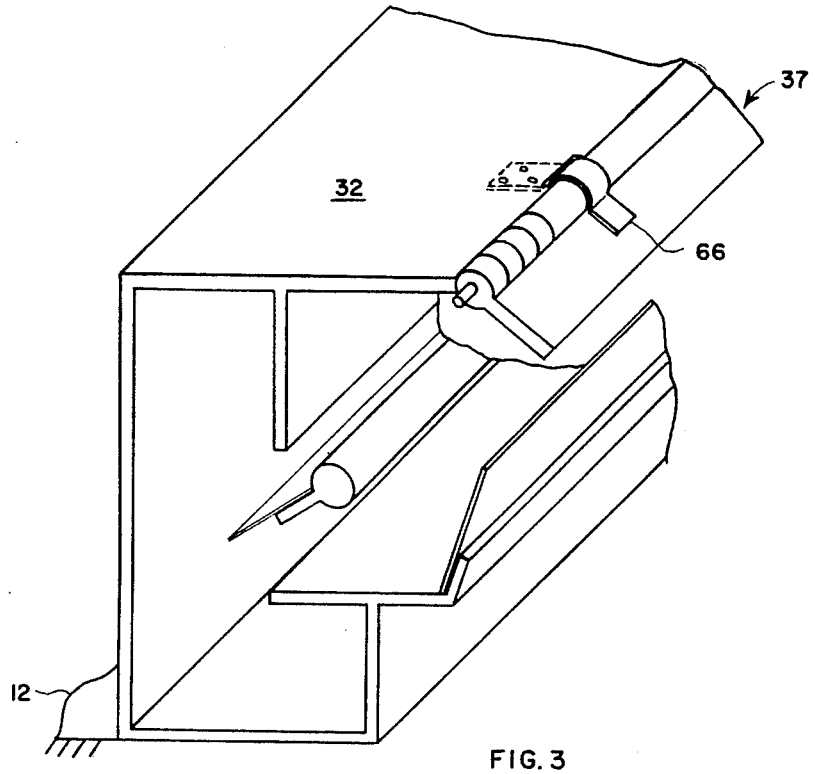
FIG. 3 is a pictorial view of an embodiment of the present invention illustrating a cleaner housing having a wiper blade assembly pivotally mounted thereon.

In embodiments of the cleaning device of the present invention illustrated in FIGS. 2 and 3, a housing 32 includes a recovery chamber 34 for the spent developer. A recovery aperture 36 is provided substantially along the length of the housing. A wiper blade assembly 37 having a blade 38 mounted thereon for engagement with drum 11 is provided along an upper edge surface 40 of housing 32, and particle guide member 39 is provided along a lower edge surface 42, the space between blade 38 and lower surface 42 defining aperture 36. A flexible plate 44 is shown mounted on a shaft 46 in housing 32 to be rotatably driven by a driver (not shown). Plate 44 transports the developer from a horizontal receiving plate 47 into a lower chamber 48 of the housing in a manner well known in the art. To facilitate cleaning of the housing, particle guide member 39 is secured to an inside surface 49 of the housing along lower edge surface 42. In this manner, particles will not fall and lodge or be "captured" between the guide member and an outside surface of lower edge surface 42 of the housing.

As can be seen in FIG. 2, pivoting means is provided to pivotally mount the housing in the copying apparatus and includes a plurality of spaced mounting members or ears 50 which extend from support member 12 and are disposed along the lower edge surface 51 of housing 32. A rod 52 extends into openings 53 in ears 50 and in similar openings in similar members 55 which extend from support member 12 in intermeshing relation with members 50. Should it be desirable to empty the spent developer particles, an opening 54 is provided in the bottom 56 of the housing. A plug 58 is provided to close the opening. The back 60 of the housing may be pivotally mounted, as shown at pivot connection 62, to permit the back to be opened to provide access into the interior of the housing. Any of many types of known locking assemblies 63 may be provided to return the back 60 in closed position.

To provide for biased relation of the housing and thus the blade 38 against drum 11, a spring 61 is mounted between housing 32 and support member 12. It is to be understood that support member 12 may be a part of apparatus 10 or the process kit carried in the copying apparatus in which the corona devices, developer, and cleaner housing are carried.

In the embodiment of the invention shown in FIG. 3, the housing may be rigidly mounted to support member 12 of apparatus 10 and the blade assembly 37 pivotally mounted to housing 32 by a spring 66 which biases the blade 38 against the drum. While springs 61 (FIG. 2) and 66 (FIG. 3) are shown as torsion springs, obviously other types of springs may be resorted to, it being necessary that the blade engage the drum with a predetermined force which is insufficient to scratch or damage the surface of the drum while maintaining a predetermined force against the drum.

In the embodiment shown in FIG. 3, the blade is removably secured to the housing. A rod 63 extends through openings provide in ear members 65 and 67 extending from housing 32 and blade 38 in intermeshing relationship. The rod may be relatively tight fitting in the openings or may be held in place by clips or the like (not shown) disposed at the ends thereof.

Figure 4:
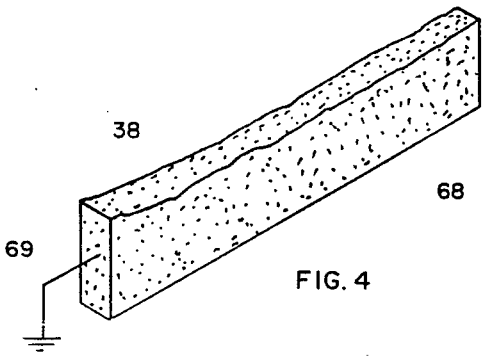
FIG. 4 is a pictorial viw of an elecrically conductive wiper blade used in one embodiment of the present invention.

The wiper blade may be made of plastic, Mylar TM, or similar types of material, it being required that the blade not scratch the drum. Additionally, the blade may be made of an electrically conductive material as shown in FIG. 4. The electrically conductive blade may be made of a somewhat soft plastic-like material having conductive particles of graphite 68 or the like and an electrical ground connection 69 embedded therein and as shown in FIG. 4. In this embodiment, the blade cleans and provides a conductive path from the drum to discharge any residual electrical charged left on the drum after the development process.

Figure 5:
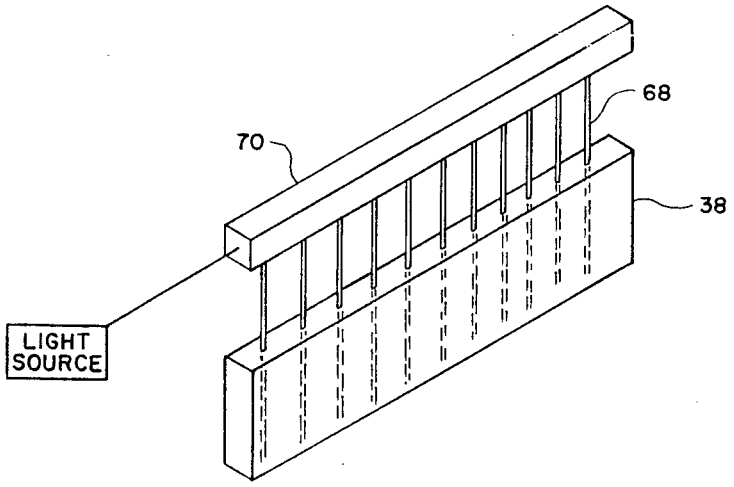
FIG. 5 is a pictorial view of a light conducting wiper blade used in an embodiment of the present invention.
Figure 6:
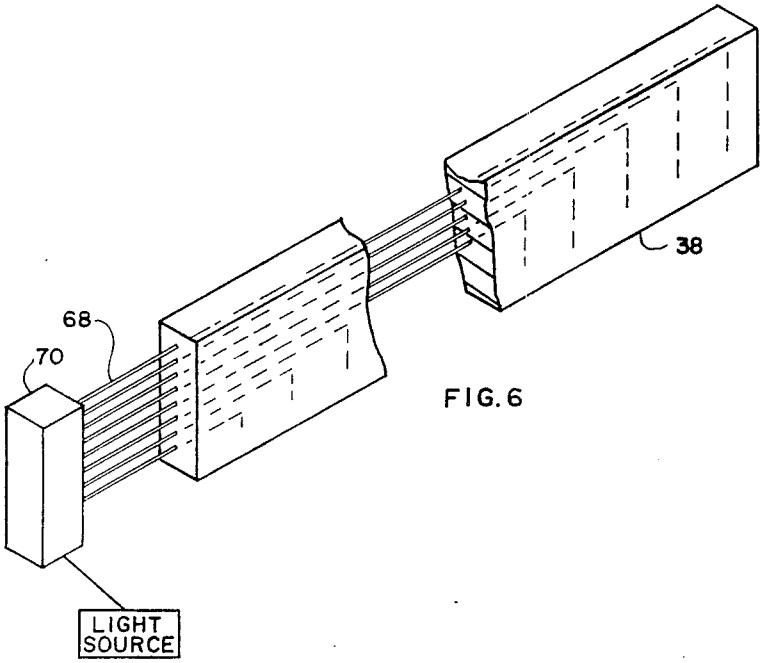
FIG. 6 is a pictorial view similar to FIG. 5 showing the light conduting fibers running along the length of the wiper blade.

Another embodiment of the present invention is shown in FIGS. 5 and 6, which illustrate blade 38 as having optical fibers 68 embedded therein to direct a light source from a source 70 to the surface of the drum which may be enclosed in the process kit. The fiber optics assembly may consist of a plurality of fibers 68 transversely extending across the interior of the blade (FIG. 5) or extending longitudinally through the blade (FIG. 6).

Figure 8:
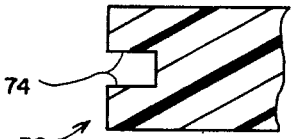
FIGS. 7–13 illustrate different configuration of the wiper blade of the present invention.
Figure 7:
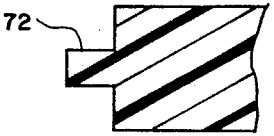
Figure 11:
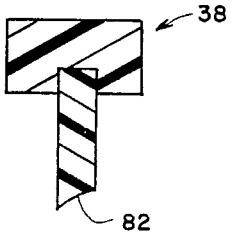
Figure 10:
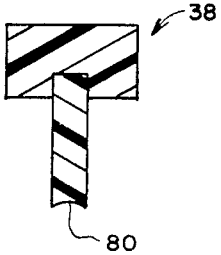
Figure 9:
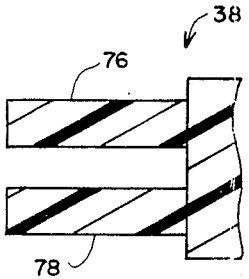
Figure 12:
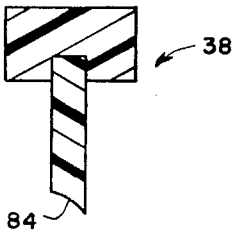
Figure 13:
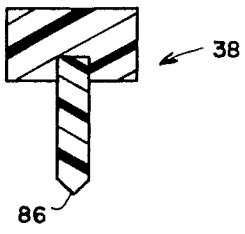

FIGS. 7–13 illustrate different configurations of the blades. FIG. 7 illustrate a blade 38 having a protrusion 72. FIG. 8 illustrates a blade 38 having a groove or slot 74 along the length thereof. FIG. 9 shows the blade 38 having a pair of spaced members 76 and 78 extending therefrom. FIG. 10 illustrates the blade 38 as having an arcuate surface 80. The arcuate surface is provided with the same radius as that of drum 12. FIG. 11 illustrates the blade 38 as having an angled surface 82. FIG. 12 shows blade 38 as having a semi-arcuate surface 84, the surface 84 having a radius substantially the same as the radius of the drum. FIG. 13 illustrates blade 38 as having a point 86.

Figure 14:
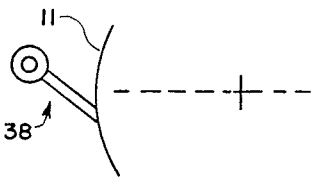
FIGS. 14–16 illustrate different angles of contact the blade may make with the surface of the drum.
Figure 15:
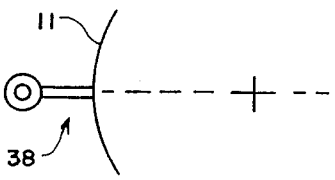
Figure 16:
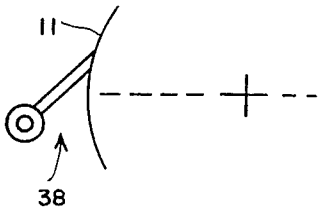

FIGS. 14–16 illustrate different ways the blade may be pivotally mounted for engaging drum 11. FIG. 14 illustrates the blade 38 being pivotally mounted above the axis of the drum and engaging the drum below the axis. FIG. 15 illustrates the pivot connection and the blade along the axis of the drum. FIG. 16 illustrates the pivot point of the blade being below the axis of the drum and the contact point being above the axis of the drum.

What is claimed is:

1. A cleaning device for an electrophotographic copying device wherein an electrophotographic latent image formed on the surface of a photosensitive member is moved past a series of processing stations including a developing station at which said latent image is developed with a toner to form a toner image, a transfer station at which said toner image is transferred to a copying material, and a cleaning station at which toner is removed from said photosensitive surface, comprising:

support means for support of said processing stations;

a cleaning housing pivotally mounted on said support means, said cleaning housing having a reservoir therein and an aperture extending longitudinal along said housing in communication with said reservoir to direct spent toner particles therein;

a wiper blade secured to said housing adjacent to said upper longitudinal surface and extending therefrom, said blade including a cleaning edge disposed for contact with the surface of said photosensitive member and for application of a predetermined pressure to said photosensitive surface responsive to said contact for cleaning said toner from said photosensitive surface; and biasing means for biasing said blade against said surface of said photosensitive member for maintaining said predetermined pressure between said blade and said photosensitive surface.

2. Apparatus as set forth in claim 1 including blade support means for releasably securing said blade to said housing.

3. Apparatus as set forth in claim 1 wherein said biasing means is a spring operatively engaging said support means and said housing for providing said predetermined pressure between said blade carried by said housing and said photosensitive surface.

4. Apparatus as set forth in claim 1 wherein said blade is provided with discharging means for removing an electrostatic charge placed on said photosensitive member in addition to performing the drum cleaning function.

5. Apparatus as set forth in claim 4 wherein said discharging means is an electrically conductive material carried by said blade having an electrical ground secured thereto, said electrically conductive material disposed for removing an electrostatic charge placed on said photosensitive member.

6. Apparatus as set forth in claim 1 wherein said blade is electrically non-conductive.

7. Apparatus as set forth in claim 1 including access means disposed in said housing for providing access into the interior thereof.

8. Apparatus as set forth in claim 7 wherein said access means is a door pivotally disposed in said housing.

9. A cleaning device for an electrophotographic copying device wherein an electrophotographic latent image formed on the surface of a photosensitive member is moved past a series of processing stations including a station for placing an electrostatic charge on said photosensitive member, a developing station at which said latent image is developed with a toner to form a toner image, and a transfer station at which said toner image is transferred to a copying material, comprising:

a housing having a reservoir therein and an aperture extending longitudinally along said housing in communication with said reservoir to direct spent toner particles therein;

a wiper blade secured to said housing and extending therefrom, said blade including a cleaning edge disposed for contact with the surface of said photosensitive member and for application of a predetermined pressure to said photosensitive surface responsive to said contact for cleaning said toner from said photosensitive surface; and fiber optic means carried in said blade, said fiber optic means disposed in communication with a source of light to direct said light onto said photosensitive surface, whereby said wiper blade removes any remaining electrostatic charge on said photosensitive member after the development process while simultaneously cleaning toner particles from said photosensitive surface.

10. Apparatus as set forth in claim 9 wherein said fiber optics extend from said source and transversely across said blade and terminates adjacent said cleaning edge.

11. Apparatus as set forth in claim 9 wherein said fiber optics extend from source and longitudinally through said blade for a discrete distance and terminates adjacent said cleaning edge.

12. Apparatus as set forth in claim 9 wherein said blade is electrically non-conductive.

13. Apparatus as set forth in claim 9 including access means disposed in said housing for providing access into the interior thereof.

14. Apparatus as set forth in claim 13 wherein said access means is a door pivotally disposed in said housing.

* * * * *